US005783773A

United States Patent [19]

Poole

[11] Patent Number: 5,783,773

[45] Date of Patent: Jul. 21, 1998

[54] LOW-RESIDUE AZIDE-FREE GAS GENERANT COMPOSITION

[75] Inventor: Donald R. Poole, Port Orchard, Wash.

[73] Assignee: Automotive Systems Laboratory Inc., Farmington Hills, Mich.

[ * ] Notice: The term of this patent shall not extend beyond the expiration date of Pat. No. 5,531,941.

[21] Appl. No.: 531,631

[22] Filed: Sep. 21, 1995

Related U.S. Application Data

[60] Continuation-in-part of Ser. No. 467,182, Jun. 6, 1995, Pat. No. 5,531,941, which is a division of Ser. No. 101,848, Aug. 4, 1993, abandoned, which is a continuation-in-part of Ser. No. 867,439, Apr. 13, 1992, abandoned.

[51] Int. Cl.[6] ..... C06B 47/08

[52] U.S. Cl. ..... 149/36; 149/47; 149/109.2; 149/109.6; 264/3.4

[58] Field of Search ..... 149/36, 46, 92

[56] References Cited

U.S. PATENT DOCUMENTS

| | | | |
|---|---|---|---|
| 3,044,123 | 7/1962 | Grubaugh . | |
| 3,071,617 | 1/1963 | Hass . | |
| 3,719,604 | 3/1973 | Prior er al. . | |
| 3,954,528 | 5/1976 | Chang et al. | 149/19.4 |
| 4,111,728 | 9/1978 | Ramnarace . | |
| 4,124,368 | 11/1978 | Boyars . | |
| 4,234,363 | 11/1980 | Flanagan | 149/19.4 |
| 4,300,962 | 11/1981 | Stinecipher et al. . | |
| 4,552,736 | 11/1985 | Mishra . | |
| 4,601,344 | 7/1986 | Reed, Jr. et al. . | |
| 4,909,549 | 3/1990 | Poole et al. . | |
| 4,925,503 | 5/1990 | Canterberry et al. . | |
| 4,925,600 | 5/1990 | Hommel et al. | 264/3.4 |
| 4,931,112 | 6/1990 | Wardle et al. . | |
| 4,948,439 | 8/1990 | Poole et al. . | |
| 5,034,072 | 7/1991 | Becuwe . | |
| 5,035,757 | 7/1991 | Poole . | |
| 5,074,938 | 12/1991 | Chi | 149/21 |
| 5,098,683 | 3/1992 | Mehrotra et al. | 423/266 |
| 5,125,684 | 6/1992 | Cartwright | 280/736 |
| 5,139,588 | 8/1992 | Poole . | |
| 5,197,758 | 3/1993 | Lund et al. . | |

*Primary Examiner*—Charles T. Jordan
*Assistant Examiner*—John R. Hardee
*Attorney, Agent, or Firm*—Lyman R. Lyon, P.C.

[57] ABSTRACT

Gas generant compositions without highly toxic azides are provided which, upon combustion, are converted into gaseous products with only small amounts of solid combustion products thereby minimizing the gas filtration problem. Gas generants having ammonium nitrate safely phase stabilized by mixture with wet triaminoguanidine are provided. A process for safely preparing the gas generants is also provided. These compositions are especially suitable for inflating automotive and aircraft occupant restraint bags.

12 Claims, No Drawings

LOW-RESIDUE AZIDE-FREE GAS GENERANT COMPOSITION

CROSS REFERENCES TO RELATED APPLICATIONS

This application is a Continuation-In-Part of U.S. patent application Ser. No. 08/467,182, filed Jun. 6, 1995, now U.S. Pat. No. 55,531,941 entitled "Low Residue Azide-Free Gas Generant Composition," which is a Division of U.S. patent application Ser. No. 08/101,848, filed Aug. 4, 1993, entitled "Low Residue Azide-Free Gas Generant Composition," now abandoned, which is a Continuation-In-Part of U.S. patent application Ser. No. 07/867,439, filed Apr. 13, 1992, entitled "Low Residue Azide-Free Gas Generant Composition," now abandoned.

BACKGROUND OF THE INVENTION

1. Field of the Invention

Inflatable devices for occupant restraint in vehicles or aircraft have been under development worldwide for many years. Patents have been granted on numerous gas generating compositions for inflating occupant restraint devices. Because of the strict requirements related to the nontoxic nature of the inflating gases most, if not all, gas generants now in use are based on azides, and especially sodium azide.

The use of sodium azide (or other azides) results in extra expense and risk in gas generant manufacture due to the extreme toxicity of azides. In addition, the potential hazard and disposal problem of unfired inflation devices must be considered. A nonazide containing gas generant is believed to provide significant advantages over an azide-based gas generant because of these toxicity related concerns.

An additional problem with azide-based gas generants is that they are relative poor gas producers. Sodium azide, the primary gas source in azide-based gas generants, consists of only 64.6% nitrogen. In order to make a useful gas generant, however, other materials, such as oxidizers and slag formers must be added to the sodium azide. These additives produce little or no gas and therefore reduce the overall yield of gas to approximately 40 to 55% by weight (or approximately 1.3 to 2.0 moles of gas per 100 grams of gas generants).

The nongaseous fraction (45 to 60%) of the gas generant products must be contained or filtered in order to provide a clean inflating gas. This filter requires additional volume thereby increasing the size of the gas generator. The large fraction of nongaseous material is very hot and by remaining in the gas generator causes the gas generator to become hot and can result in a "soak back" temperature problem.

There are, therefore, several advantages to gas generants which produce more gas and less solids. Several attempts have been made to solve the problems mentioned above by the use of azide-free gas generants.

2. Description of the Prior Art

The compositions described in Poole et al, U.S. Pat. Nos. 4,909,549 and 4,948,439, describe the use of tetrazole or triazole compounds in combination with metal oxides and oxidizer compounds (alkali metal, alkaline earth metal, and ammonium nitrates or perchlorates) as gas generant compositions.

The compositions described in Poole, U.S. Pat. No. 5,035,757, result in more easily filterable solid products but the gas yield is without substantial improvement.

Chang et al, U.S. Pat. No. 3,954,528, describes the use of triaminoguanidine nitrate ("TAGN") and a synthetic polymeric binder in combination with an oxidizing material. The oxidizing materials include ammonium nitrate ("AN") although the use of phase stabilized ammonium nitrate ("PSAN") is not suggested. The patent teaches the preparation of propellants for use in guns or other devices where large amounts of carbon monoxide and hydrogen are acceptable and desirable.

Grubaugh, U.S. Pat. No. 3,044,123, describes a method of preparing solid propellant pellets containing AN as the major component. The method requires use of an oxidizable organic binder (such as cellulose acetate, PVC, PVA, acrylonitrile and styrene-acrylonitrile), followed by compression molding the mixture to produce pellets and by heat treating the pellets. These pellets would certainly be damaged by temperature cycling because commercial AN is used and the composition claimed would produce large amounts of carbon monoxide.

Becuwe, U.S. Pat. No. 5,034,072, is based on the use of 5-oxo-3-nitro-1,2,4-triazole as a replacement for other explosive materials (HMX, RDX, TATB, etc.) in propellants and gun powders. This compound is also called 3-nitro-1,2,4-triazole-5-one ("NTO"). The claims appear to cover a gun powder composition which includes NTO, AN and an inert binder, where the composition is less hygroscopic than a propellant containing ammonium nitrate. Although called inert, the binder would enter into the combustion reaction and produce carbon monoxide making it unsuitable for air bag inflation.

Lund et al, U.S. Pat. No. 5,197,758, describes gas generating compositions comprising a nonazide fuel which is a transition metal complex of an aminoarazole, and in particular are copper and zinc complexes of 5-aminotetrazole and 3-amino-1,2,4-triazole which are useful for inflating air bags in automotive restraint systems.

In addition to U.S. Pat. Nos. 5,035,757 and 3,954,528 described hereinabove, the following U.S. Patents were cited in application Ser. No. 07/867,439 of which the present application is a Continuation-In-Part.

Wardle et al, U.S. Pat. No. 4,931,112, describes an automotive air bag gas generant formulation consisting essentially of NTO (5-nitro-1,2,4-triazole-3-one) and an oxidizer wherein said formulation is anhydrous.

Reed, Jr. et al, U.S. Pat. No. 4,601,344, describes a gas generating composition containing glycidyl azide polymer and a high nitrogen content additive which generates large amounts of nitrogen gas upon burning and is useful to extinguish fires.

Flanagan, U.S. Pat. No. 4,234,363, describes a solid propellant hydrogen generator comprising an oxidizer, a fuel, and a binder such as a polyester binder said generator being useful for chemical laser systems.

Ramnarace, U.S. Pat. No. 4,111,728, describes gas generators for inflating life rafts and similar devices or useful as rocket propellants comprising ammonium nitrate, a polyester type binder and a fuel selected from oxamide and guanidine nitrate.

Boyars, U.S. Pat. No. 4,124,368, describes a method for preventing detonation of ammonium nitrate by using potassium nitrate.

Mishra, U.S. Pat. No. 4,552,736, and Mehrotra et al, U.S. Pat. No. 5,098,683, describe the use of potassium fluoride to eliminate expansion and contraction of ammonium nitrate in transition phase.

Chi, U.S. Pat. No. 5,074,938, describes the use of phase stabilized ammonium nitrate as an oxidizer in propellants containing boron and useful in rocket motors.

Canterberry et al, U.S. Pat. No. 4,925,503, describes an explosive composition comprising a high energy material, e.g., ammonium nitrate and a polyurethane polyacetal elastomer binder, the latter component being the focus of the invention.

Hass, U.S. Pat. No. 3,071,617, describes long known considerations as to oxygen balance and exhaust gases.

Stinecipher et al, U.S. Pat. No. 4,300,962, describes explosives comprising ammonium nitrate and an ammonium salt of a nitroazole.

Prior, U.S. Pat. No. 3,719,604, describes gas generating compositions comprising aminoguanidine salts of azotetrazole or of ditetrazole.

Cartwright, U.S. Pat. No. 5,125,684, describes an extrudable propellant for use in crash bags comprising an oxidizer salt, a cellulose-based binder and a gas generating component.

Poole, U.S. Pat. No. 5,139,588, describes nonazide gas generants useful in automotive restraint devices comprising a fuel, an oxidizer and additives.

DETAILED DESCRIPTION OF THE PREFERRED EMBODIMENT(S)

Gas generant compositions without highly toxic azides are provided which, upon combustion, are converted into gaseous products with only small amounts of solid combustion products thereby minimizing the gas filtration problem. A process for safely preparing the gas generants are also provided. These compositions are especially suitable for inflating automotive and aircraft occupant restraint bags.

In one aspect, the invention comprises gas generant compositions. The principal advantage of the gas generant compositions of the invention is in the very high gas yields and consequently low yield of solid combustion products. gas yields of greater than 90% by weight are obtained and consequently only 10% (at most) solid combustion products are produced. The actual yields are approximately 94% gas and 6% solids and are therefore much better than previous gas generants intended for automotive and aircraft air bag use. The high gas yield permits a smaller inflator and the low solid output allows a smaller and less expensive filter.

The invention in one preferred embodiment comprises an azide-free gas generant that produces exhaust gases on combustion for inflating vehicle or aircraft occupant restraint devices. The generant comprises a) PSAN as an oxidizer and b) at least one nitrogen containing fuel. The preferred embodiment is particularly unique in that it does not contain a binder. Fuels suitable in practicing the present invention are high in nitrogen content and low in carbon content to provide a high rate of burn and minimize the amount of carbon monoxide formed upon combustion. Suitable fuels for use in the present invention are selected from TAGN, diaminoguanidine nitrate ("DAGN"), monoguanidine nitrate ("MAGN"), guanidine nitrate ("GN"), NTO, oxamide, or mixtures of two or more of the group of fuels. A preferred fuel is TAGN or a mixture thereof with at least one other fuel, as described, where TAGN is in higher concentration. Preferably, the ratio of oxidizer to fuel is adjusted such that the amount of oxygen allowed in the equilibrium exhaust gases is less than 2 or 3% by volume, and more preferably less than 2.0% by volume.

One preferred gas generant composition for air bag inflation comprises a mixture of a) PSAN, about 64.7 wt. %, and b) TAGN, about 31.77 wt. %, and c) oxamide, about 3.53 wt. %. Another preferred composition comprises a mixture of a) PSAN, about 59.3 to about 60.5 wt. %, and b) TAGN, about 39.5 to about 40.7 wt. %. Still another preferred composition comprises a) PSAN, about 59.4 wt. %, b) TAGN, about 32.48 wt. %, and c) GN, about 8.12 wt. %. Another example of a suitable composition is a) PSAN, about 52.5 wt. %, and b) NTO, about 47.5 wt. %.

The gas generant compositions in another preferred embodiment are those where the oxidizer and the fuel are mixed and compressed in pellet form, and the oxidizer is present in about 50 to 80% by weight such that on combustion the burning rate of the pellet composition is substantially greater than 0.3 inch per second at 1000 psi and more preferably 0.5 inch per second at 1000 psi.

The invention in another preferred aspect comprises a process for preparing an azide-free gas generant composition, comprising the steps of a) dissolving together weighed amounts of AN and potassium nitrate ("KN") in hot water, b) cooling and drying the resulting solution to obtain dry PSAN, c) grinding to a powder and weighing the thus obtained dry AN powder, d) drying and weighing the fuel comprising TAGN, e) mixing the dry AN powder and the dry fuel, f) grinding the resulting dry mixture to a powder, and g) molding the powder under pressure into pellets.

The invention in another preferred embodiment comprises a process for preparing an azide-free gas generant composition, comprising the steps of a) mixing weighed amounts of PSAN with TAGN and drying and grinding the resulting dry mixture to a powder, and b) molding the powder under pressure into pellets.

The invention in another preferred embodiment comprises a process for preparing an azide-free gas generant composition, comprising the steps of a) using TAGN that is wet with water or alcohol by a wet process, b) mixing weighed amounts of dry AN and dry KN with a weighed amount of said wet TAGN to obtain a wet gas generant mixture thereby forming PSAN in the mixture, c) drying and grinding the thus dried gas generant mixture to obtain a powder, and d) molding the powder under pressure into pellets.

The process for safely preparing the gas generants applies primarily to compositions using TAGN or mixtures of TAGN and other materials with AN or PSAN.

TAGN, when dry, is a class A or class 1.1 explosive with an impact sensitivity of approximately 45 kgcm and therefore presents a safety hazard for handling, transportation and storage. TAGN is usually shipped and stored while wet with water or alcohol to reduce the hazards.

TAGN can easily be made by several processes which are described in U.S. Pat. Nos. 5,041,661; 3,950,421; 3,285,958 and 4,800,232. These processes produce crystalline TAGN which is washed and dried in the final stages of the process. Instead of drying the TAGN, if according to the present invention it is mixed, while still wet to obtain a wet gas generant mixture, with AN or a combination of AN and a potassium salt, the TAGN is converted to a less sensitive mixture thereby avoiding the problem of handling dry TAGN. This method also avoids a separate process for making PSAN. The primary advantage is in not having to dry out and handle a sensitive explosive in the dry state.

Oxidizer

The oxidizer (PSAN) provides the oxygen to convert all carbon to carbon dioxide and hydrogen to water. One of the major problems with the use of AN is that it undergoes several crystalline phase changes. One of these phase changes occurs at approximately 32° C. and is accompanied by a large change in volume. If a gas generant containing a significant amount of AN is thermally cycled above and below this temperature, the AN crystals expand and contract and change shape resulting in growth and cracking in the gas generant. This is totally unacceptable in a gas generant used in air bag inflators because the burning characteristics would be altered such that the inflator would not operate properly or might even blow up because of the excess pressure generated. In order to avoid this problem it is essential that only PSAN is used.

Several methods of phase stabilizing AN are known. It is well known for example that potassium incorporated into the crystal structure is effective in phase stabilizing AN. Most commonly 8 to 15% by weight of KN is added to AN in aqueous solution for this purpose although other potassium salts also effect stabilization.

Other methods of phase stabilizing AN include the use of desiccants and other coatings on the AN particles.

The unique feature of AN is that it is the only known oxidizer with acceptable physical properties (except for the phase change problem) for air bag gas generant usage which produces no solid residue or large amounts of toxic gases. Ammonium perchlorate produces no solid residue but produces large amounts of toxic hydrogen chloride.

The amount of solid residue produced by PSAN is directly dependent upon the method of stabilization but most methods produce less solid residue than would be produced by more conventional oxidizers such as sodium nitrate or potassium perchlorate. While PSAN is essential, any method of stabilization which works and does not produce toxic products is contemplated by the invention. For example, mixing an appropriate amount of potassium oxalate with AN would be such an appropriate method.

The amount of oxidizer needed is dependent on the type of fuel used and can be determined readily by one skilled in the art based on the oxygen balance of the fuel. The oxidizer and fuel ratio is adjusted so that there is a small excess of oxygen in the product gases in order to minimize the amount of carbon monoxide produced. A large excess of oxygen is avoided in order to limit the amount of $NO_x$ produced.

Fuel

The fuel component of the gas generant may be selected from various nitrogen containing components as described. In general, compounds having high nitrogen and low carbon content are best. TAGN is also valuable because it increases the burn rate of AN/fuel mixtures. Gas generants using AN as the oxidizer are generally very slow burning with burning rates at 1000 psi typically less than 0.1 inch per second. In air bag gas generants burning rates of less than about 0.4 to 0.5 inch per second are difficult to use. Because of its effect on burning rate, TAGN and mixtures of TAGN with other fuels, where TAGN has the higher concentration, are preferred.

As mentioned above, the fuel concentration is correlated with the oxidizer concentration so as to produce a small amount of oxygen in the combustion products. This range of fuel is therefore generally from about 20 to 50% by weight depending on the ratio of carbon, hydrogen and oxygen in the fuel molecule.

The invention and best mode of practicing the same are described in the foregoing description and the following illustrative examples.

EXAMPLE 1

A quantity of PSAN was prepared by heating a mixture of 85% AN and 15% KN with enough water to dissolve all of the solid AN and KN when heated to about 80° C. The solution was then stirred while cooling to room temperature. The resulting moist solid was then spread out in a thin layer and dried in an oven at 80° C. After drying, the solid material was ground in a simple laboratory grinder resulting in a fine granular material.

A mixture of the PSAN and NTO was prepared having the following composition in percent by weight: 52.5% PSAN and 47.5% NTO. These granular solids were blended and ground to fine powders in a ball mill, and pellets were formed by compression molding.

The burning rate of this composition was found to be 0.63 inch per second at 1000 psi. The burning rate was determined by measuring the time required to burn a cylindrical pellet of known length. The pellets were compression molded in a half-inch diameter die at approximately 16,000 pounds force and were then coated on the sides with an epoxy-titanium dioxide inhibitor which prevented burning along the sides.

The pellet forming ability of this composition was tested by compression molding pellets on a high-speed tableting press. The material was found to form pellets of excellent quality. Pellets thus formed were tested in a gas generator designed to simulate an actual air bag inflator and were found to function satisfactorily.

EXAMPLE 2

A mixture of PSAN and TAGN was prepared having the following composition in percent by weight: 60.4% PSAN and 39.6% TAGN. This gas generant composition was prepared by dissolving the required amount of AN (51.34%) and KN (9.06%) in water while heating to 60° to 80° C., adding the TAGN and cooling while stirring. The resulting moist solid was spread out in a pan and dried in an oven at 80° C. The dried material was delumped by passing through a 12 mesh sieve and was then blended and ground to a fine powder in a ball mill.

The burning rate of this composition was found to be 0.83 inch per second at 1000 psi when compression molded and measured as described in Example 1.

The pellet forming ability of this composition was tested by compression molding pellets on a high-speed tableting press. The material was found to form pellets of excellent quality. Pellets formed in this manner were tested in a gas generator designed to simulate an actual air bag inflator and were found to function satisfactorily.

EXAMPLE 3

A mixture of PSAN and TAGN was prepared having the following composition in percent by weight: 50.4% AN, 8.9% KN and 40.7% TAGN. This gas generant composition was prepared and tested as described in Example 2 and the burning rate was found to be 0.78 inch per second at 1000 psi.

EXAMPLE 4

A mixture of PSAN, TAGN and GN was prepared having the following composition in percent by weight: 59.40% PSAN, 32.48% TAGN and 8.12% GN.

This gas generant composition was prepared by dissolving the required amount of AN (50.49%) and KN (8.91%) in water while heating to 60° to 80° C., adding the TAGN and GN and cooling while stirring. The resulting moist solid was spread out in a pan and dried in an oven at 80° C. The dried material was delumped by passing through a 12 mesh sieve and was then blended and ground to a fine powder in a ball mill.

The burning rate of this composition was found to be 0.76 inch per second at 1000 psi when compression molded and measured as described in Example 1.

EXAMPLE 5

A mixture of PSAN, TAGN and oxamide was prepared having the following composition in percent by weight: 55.16% AN, 9.74% KN, 7.02% oxamide and 28.08% TAGN. This gas generant composition was prepared by the method described in Example 4.

The burning rate of this composition was found to be 0.59 inches per second at 1000 psi when compression molded and tested as described in Example 1.

EXAMPLE 6

A mixture of PSAN and TAGN was prepared having the following composition in present by weight: 54.45% AN, 6.05% KN and 39.50% TAGN.

In this example the amount of KN was reduced to 10% of the AN/KN mixture whereas in previous examples the amount of KN used was 15% of the AN/KN mixture.

This gas generant was prepared and tested as described in Example 2 and the burning rate was found to be 0.75 inches per second at 1000 psi.

EXAMPLE 7

A mixture of PSAN, TAGN, and oxamide was prepared having the following composition in percent by weight: 64.7% PSAN, 31.77% TAGN, and 3.53% oxamide. This gas generant composition was prepared by the method described in Example 4.

The burning rate of this composition was found to be 0.59 inches per second at 1000 psi when compression molded and tested as described in Example 1.

Having thus described my invention, the embodiments in which an exclusive property or privilege is claimed are defined as follows:

I claim:

1. An azide-free and binder-free gas generant composition that produces exhaust gases on combustion for inflating vehicle or aircraft occupant restraint devices in order to provide a clean inflating gas for the benefit of each vehicle or aircraft occupant, said composition consisting of:

a. an oxidizer of the group consisting of a mixture of ammonium nitrate (AN) and potassium salt, and phase stabilized ammonium nitrate (PSAN), and b. a TAGN fuel of the group consisting of:

i.) TAGN;

ii.) a mixture of TAGN and GN; and iii.) a mixture of TAGN and oxamide wherein the TAGN of each of ii.) and iii.) is in higher concentration than the concentration of GN and oxamide respectively, the oxidizer being stabilized by simultaneous admixture with wet TAGN fuel while still wet to obtain a wet PSAN/fuel mixture, the resulting PSAN/fuel mixture being dried, powdered and compression pelleted.

2. A gas generant composition according to claim 1 wherein the ratio of PSAN to fuel is adjusted such that the amount of oxygen allowed in the equilibrium exhaust gases is 3.0% by volume or less.

3. A gas generant composition according to claim 2 wherein said ratio is such that the amount of oxygen allowed is about 0.5% by volume or less.

4. A gas generant composition according to claim 1 wherein the amount of PSAN is about 50 to 80% by weight of the composition.

5. A gas generant composition according to claim 4 wherein the fuel is triaminoguanidine nitrate.

6. A gas generant composition according to claim 5 comprising a mixture (a) PSAN, about 64.7% by weight; (b) TAGN, about 31.77% by weight; and (c) oxamide, about 3.53% by weight.

7. A gas generant composition according to claim 5 comprising a mixture of (a) PSAN, about 64.90% by weight; (b) TAGN, about 28.08% by weight; and (c) oxamide, about 7.02% by weight.

8. A gas generant composition according to claim 5 comprising a mixture of (a) PSAN, about 59.4% by weight; (b) TAGN, about 32.48% by weight; and (c) guanidine nitrate, about 8.12% by weight.

9. A gas generant composition according to claim 5 comprising a mixture of (a) PSAN, about 60.50% by weight; and (b) TAGN, about 39.50% by weight.

10. A gas generant composition according to claim 5 comprising a mixture of (a) PSAN, about 59.30% by weight; and (b) TAGN, about 40.70% by weight.

11. A gas generant composition according to claim 5 comprising a mixture of (a) PSAN, about 60.40% by weight; and (b) TAGN, about 39.60% by weight.

12. An azide-free gas generant composition according to claim 1 wherein the PSAN and fuel are mixed and compressed in pellet form, and the oxidizer is present in about 50 to 80% by weight such that on combustion the burning rate of the pellet composition is substantially greater than 0.3 inch per second at 1000 psi.

* * * * *